US006427867B1

(12) United States Patent
Frebes et al.

(10) Patent No.: US 6,427,867 B1
(45) Date of Patent: Aug. 6, 2002

(54) SEWING PIN DISPENSING DEVICE

(76) Inventors: Thomas G. Frebes; Patricia Frebes, both of 1881 7 Mile, Remus, MI (US) 49340

( * ) Notice: Subject to any disclaimer, the term of this patent is extended or adjusted under 35 U.S.C. 154(b) by 0 days.

(21) Appl. No.: 09/473,094

(22) Filed: Dec. 28, 1999

(51) Int. Cl.[7] ..... B65H 5/00

(52) U.S. Cl. ..... 221/233; 221/265; 221/191; 221/239; 221/192; 221/255; 221/212

(58) Field of Search ..... 221/266, 255, 221/261, 191, 192, 233, 239, 212

(56) References Cited

U.S. PATENT DOCUMENTS

| | | | | | |
|---|---|---|---|---|---|
| 555,715 | A | * | 3/1896 | Tjerneld | 221/212 |
| 830,815 | A | * | 9/1906 | Ziebell | |
| 929,823 | A | * | 8/1909 | Bouthinon | 221/192 |
| 1,061,926 | A | * | 5/1913 | Ratzblaff | 221/191 |
| 1,085,574 | A | * | 1/1914 | Bryant | 221/233 |
| 1,175,386 | A | * | 3/1916 | Sperry | 221/192 |
| 1,182,920 | A | * | 5/1916 | Martin et al. | 221/192 |
| 1,238,381 | A | * | 8/1917 | Berry | 221/192 |
| 1,412,826 | A | * | 4/1922 | Baughman | 221/192 |
| 1,461,981 | A | | 7/1923 | Newman | |
| 1,613,622 | A | * | 1/1927 | O'Malley | 221/192 |
| 1,623,614 | A | * | 1/1927 | La Rue | 221/192 |
| 1,703,352 | A | * | 2/1929 | Moore | 221/192 |
| 2,784,873 | A | * | 3/1957 | Hartnett | 221/274 |
| 2,895,638 | A | | 7/1959 | White | |
| 3,960,299 | A | * | 6/1976 | Hollinger | 222/559 |
| 3,982,660 | A | * | 9/1976 | Hashimoto | 221/190 |
| 4,116,333 | A | | 9/1978 | Pavel | |
| 4,203,518 | A | * | 5/1980 | Current | 206/380 |
| 4,269,313 | A | * | 5/1981 | Smith | 206/380 |
| 4,308,974 | A | * | 1/1982 | Jones | 221/196 |
| D271,172 | S | | 11/1983 | Allen | |
| 4,511,058 | A | * | 4/1985 | Carminati | 221/2 |
| 4,522,314 | A | | 6/1985 | Nelson | |
| 4,798,271 | A | * | 1/1989 | Gatternamm et al. | 192/18 |
| 5,029,727 | A | | 7/1991 | Wu | |
| 5,067,632 | A | * | 11/1991 | Aubry | 221/266 |
| 5,351,857 | A | * | 10/1994 | Gonzales | 221/265 |
| 5,485,939 | A | * | 1/1996 | Tucker | 221/86 |
| 5,931,302 | A | * | 8/1999 | Isaacs et al. | 206/538 |
| 6,017,275 | A | * | 1/2000 | Webster | 470/164 |
| 6,170,122 | B1 | * | 1/2001 | Kuo | 16/405 |

FOREIGN PATENT DOCUMENTS

| | | | | |
|---|---|---|---|---|
| CA | 777633 | * | 2/1968 | 221/2 |
| DE | 2601298 | * | 7/1977 | B43M/17/00 |
| FR | 1017917 | * | 10/1952 | 221/212 |
| GB | 352143 | * | 7/1931 | 312/84 |
| GB | 2241693 A | * | 9/1991 | B65D/83/02 |

* cited by examiner

*Primary Examiner*—Christopher P. Ellis
*Assistant Examiner*—Michael E Butler

(57) ABSTRACT

A sewing pin dispensing device for placing the head of a stick pin in an upright position. The sewing pin dispensing device includes a housing. A cavity is in the housing. A first opening in the housing allows for the entry of pins to be dispensed into the housing. A pin bin formed in the housing is in communication with the first opening and the cavity. A second opening in the housing for dispensing of the pins extends downwardly into the cavity. A wheel moves the pins from the pin bin to the second opening. The wheel is rotatably mounted in the cavity. The wheel has an exterior surface. A gear is fixed to the wheel. The gear is fixedly coupled to an end of the wheel for turning the wheel. An annular slot in the wheel is in the exterior surface of the wheel and extends around the wheel. The annular slot is generally adjacent to an end of the wheel. A plurality of linear slots in the wheel each receives one of the pins. Each of the linear slots is in the exterior surface of the wheel. An actuating assembly actuates the wheel.

10 Claims, 3 Drawing Sheets

SEWING PIN DISPENSING DEVICE

BACKGROUND OF THE INVENTION

1. Field of the Invention

The present invention relates to dispensing devices and more particularly pertains to a new sewing pin dispensing device for placing the head of a stick pin in an upright position.

2. Description of the Prior Art

The use of dispensing devices is known in the prior art. More specifically, dispensing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,116,333; U.S. Pat. No. 5,029,727; U.S. Pat. No. 4,522,314; U.S. Pat. No. 1,461,981; U.S. Pat. No. 2,895,638; and U.S. Des. Pat. No. 271,172.

While these devices fulfill their respective, particular objectives and requirements, the aforementioned patents do not disclose a new sewing pin dispensing device. The inventive device includes a housing. A cavity is in the housing. A first opening in the housing allows for the entry of pins to be dispensed into the housing. A pin bin formed in the housing is in communication with the first opening and the cavity. A second opening in the housing for dispensing of the pins extends downwardly into the cavity. A wheel moves the pins from the pin bin to the second opening. The wheel is rotatably mounted in the cavity. The wheel has an exterior surface. A gear is fixed to the wheel. The gear is fixedly coupled to an end of the wheel for turning the wheel. An annular slot in the wheel is in the exterior surface of the wheel and extends around the wheel. The annular slot is generally adjacent to an end of the wheel. A plurality of linear slots in the wheel each receives one of the pins. Each of the linear slots is in the exterior surface of the wheel. An actuating assembly actuates the wheel.

In these respects, the sewing pin dispensing device according to the present invention substantially departs from the conventional concepts and designs of the prior art, and in so doing provides an apparatus primarily developed for the purpose of placing the head of a stick pin in an upright position.

SUMMARY OF THE INVENTION

In view of the foregoing disadvantages inherent in the known types of dispensing devices now present in the prior art, the present invention provides a new sewing pin dispensing device construction wherein the same can be utilized for placing the head of a stick pin in an upright position.

The general purpose of the present invention, which will be described subsequently in greater detail, is to provide a new sewing pin dispensing device apparatus and method which has many of the advantages of the dispensing devices mentioned heretofore and many novel features that result in a new sewing pin dispensing device which is not anticipated, rendered obvious, suggested, or even implied by any of the prior art dispensing devices, either alone or in any combination thereof.

To attain this, the present invention generally comprises a housing. A cavity is in the housing. A first opening in the housing allows for the entry of pins to be dispensed into the housing. A pin bin formed in the housing is in communication with the first opening and the cavity. A second opening in the housing for dispensing of the pins extends downwardly into the cavity. A wheel moves the pins from the pin bin to the second opening. The wheel is rotatably mounted in the cavity. The wheel has an exterior surface. A gear is fixed to the wheel. The gear is fixedly coupled to an end of the wheel for turning the wheel. An annular slot in the wheel is in the exterior surface of the wheel and extends around the wheel. The annular slot is generally adjacent to an end of the wheel. A plurality of linear slots in the wheel each receives one of the pins. Each of the linear slots is in the exterior surface of the wheel. An actuating assembly actuates the wheel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sewing pin dispensing device apparatus and method which has many of the advantages of the dispensing devices mentioned heretofore and many novel features that result in a new sewing pin dispensing device which is not anticipated, rendered obvious, suggested, or even implied by any of the prior art dispensing devices, either alone or in any combination thereof.

It is another object of the present invention to provide a new sewing pin dispensing device which may be easily and efficiently manufactured and marketed.

It is a further object of the present invention to provide a new sewing pin dispensing device which is of a durable and reliable construction.

An even further object of the present invention is to provide a new sewing pin dispensing device which is susceptible of a low cost of manufacture with regard to both materials and labor, and which accordingly is then susceptible of low prices of sale to the consuming public, thereby making such sewing pin dispensing device economically available to the buying public.

Still yet another object of the present invention is to provide a new sewing pin dispensing device which provides in the apparatuses and methods of the prior art some of the advantages thereof, while simultaneously overcoming some of the disadvantages normally associated therewith.

Still another object of the present invention is to provide a new sewing pin dispensing device for placing the head of a stick pin in an upright position.

Yet another object of the present invention is to provide a new sewing pin dispensing device which includes a housing. A cavity is in the housing. A first opening in the housing allows for the entry of pins to be dispensed into the housing. A pin bin formed in the housing is in communication with the first opening and the cavity. A second opening in the housing for dispensing of the pins extends downwardly into the cavity. A wheel moves the pins from the pin bin to the second opening. The wheel is rotatably mounted in the cavity. The wheel has an exterior surface. A gear is fixed to the wheel. The gear is fixedly coupled to an end of the wheel for turning the wheel. An annular slot in the wheel is in the exterior surface of the wheel and extends around the wheel. The annular slot is generally adjacent to an end of the wheel. A plurality of linear slots in the wheel each receives one of the pins. Each of the linear slots is in the exterior surface of the wheel. An actuating assembly actuates the wheel.

Still yet another object of the present invention is to provide a new sewing pin dispensing device that prevents the stick pins from injuring the sewer as the sewer reaches for a pin.

Even still another object of the present invention is to provide a new sewing pin dispensing device that could be made into an electric version which automatically places the head of a stick pin in an upright position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
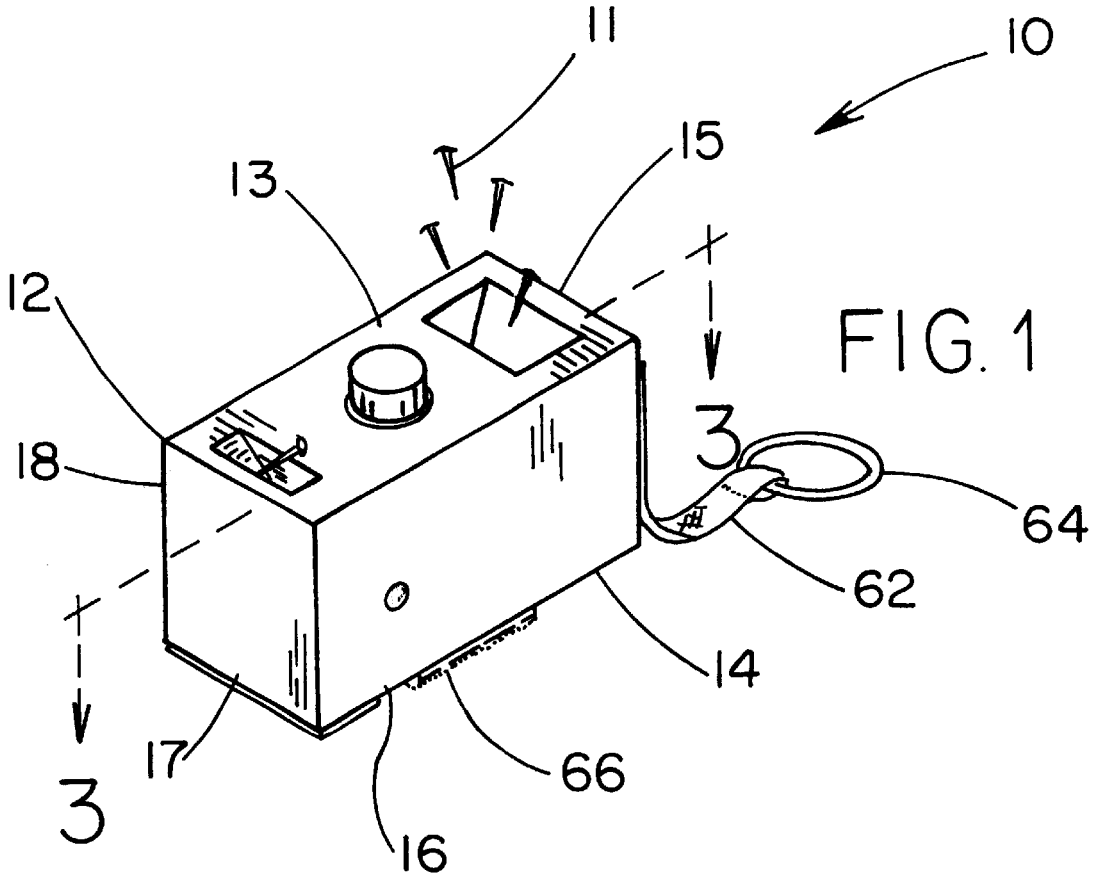
FIG. 1 is a schematic perspective view of a new sewing pin dispensing device according to the present invention.
Figure 2:
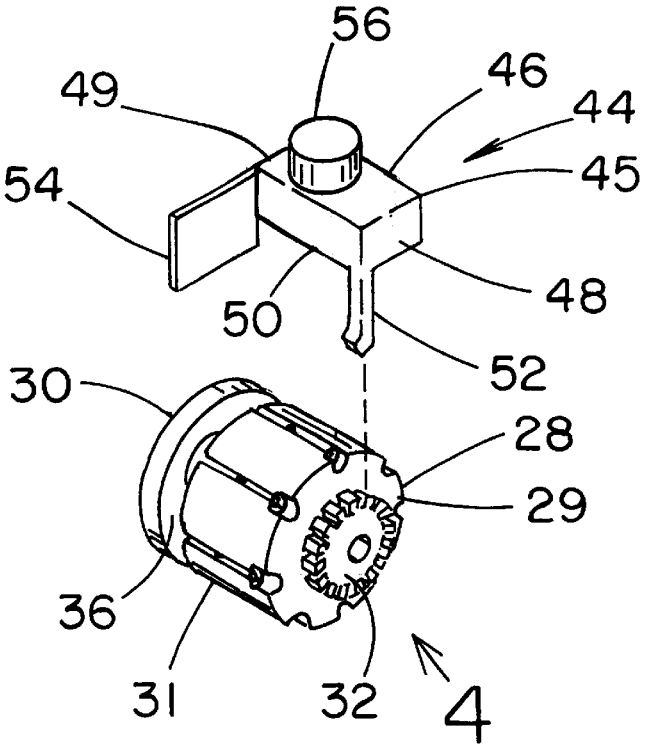
FIG. 2 is a schematic perspective view of the wheel and actuating assembly of the present invention.
Figure 3:
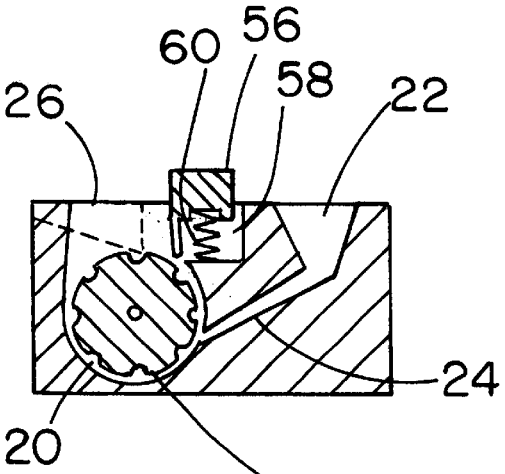
FIG. 3 is a schematic side cross-sectional view taken along line 3—3 of the present invention.
Figure 5:
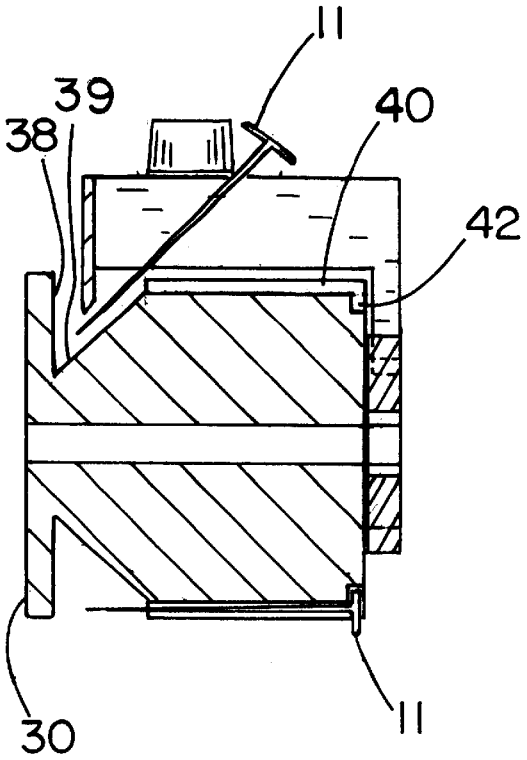
FIG. 5 is a schematic cross-sectional view of the wheel and actuating assembly taken along line 5—5 of the present invention.
Figure 4:
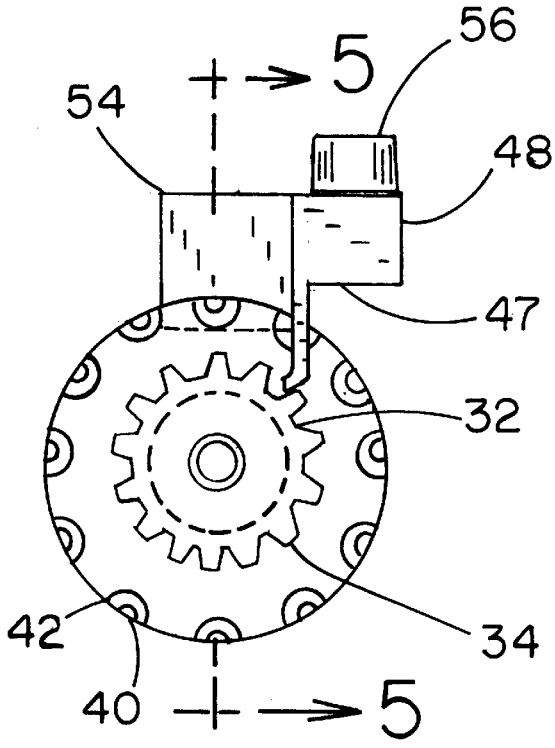
FIG. 4 is a schematic side view of the wheel and actuating assembly of the present invention.

With reference now to the drawings, and in particular to FIGS. 1 through 5 thereof, a new sewing pin dispensing device embodying the principles and concepts of the present invention and generally designated by the reference numeral 10 will be described.

As best illustrated in FIGS. 1 through 5, the sewing pin dispensing device 10 generally comprises a housing 12 having a top wall 13, a bottom wall 14, a first side wall 15, a second side wall 16, a third side wall 17 and a fourth side wall 18. The first 15 and third 17 side walls are opposite walls and the second 16 and fourth 18 side wall are opposite walls. Each of the walls preferably has a generally rectangular shape.

A cavity 20 in the housing 12 is located generally adjacent to the third wall 17 and the bottom wall 14. The cavity 20 has a generally cylindrical cross-section taken along a plane parallel to the second 16 and fourth 18 walls.

A first opening 12 in the housing 12 for entry of pins 11 to be dispensed into the housing is in the top wall 13 of the housing 12. The first opening 22 is located generally adjacent to the first wall 15. A pin bin 24 is formed in the housing 12 and is in communication with the first opening 22 and the cavity 20, A second opening 26 in the housing 12 dispenses the pins 11. The second opening 26 extends downwardly into the cavity 20. The second opening 26 is in the top wall 13 of the housing 12. The second opening 26 is located generally adjacent to the third wall 17.

A wheel 28 moves the pins 11 from the pin bin 24 to the second opening 26. The wheel 28 is rotatably mounted in the cavity 20 and has a first end 29, a second end 30 and an exterior surface 31. The wheel 28 has a width approximately equal to a width of the cavity 20. The length of the wheel 28 is longer than the length of a stick pin 11. The wheel 28 has a length generally equal to a length of the cavity 20.

A gear 32 is fixed to the wheel 28. The gear 32 is fixedly coupled to the first end 29 of the wheel 28 for turning the wheel 28. The gear 32 is positioned generally coaxial with the wheel 28 and has an edge with teeth 34 formed thereon.

An annular slot 36 is in the exterior surface 31 of the wheel 28 and extends around the wheel. The annular slot 36 is generally adjacent to the second end 30 of the wheel 28. The annular slot 36 has a first wall 38 and a second wall 39. The first wall 38 of the annular slot 36 is generally adjacent to the second end 30 of the wheel 28. The first wall 38 is generally parallel with the second wall 16 of the housing 12. The second wall 39 of the annular slot 36 is angled toward the first end 29 of the wheel 28 to form an acute angle with exterior surface 31 of the wheel 28.

A plurality of linear slots 40 in the wheel 28 each receives one of the pins 11. Each of the linear slots 40 is in the exterior surface 31 of the wheel 28. Each of the linear slots 40 extends from the annular slot 36 toward the first end 29 of the wheel 28. Each of the linear slots 40 has an end portion 42. The end portions 42 are generally located adjacent to the first end 29 of the wheel 28. Each of the end portions 42 is adapted to receive a head of a pin 11. The end portions 42 of the linear slots 40 have a width greater than a remainder portion of each of the linear slots. Preferably, the linear slots 40 are generally hemi-cylindrical.

An actuating assembly 44 actuates the wheel 28. The actuating assembly 44 has a base portion 45. The base portion 45 has a top surface 46, a bottom surface 47, a first opposing wall 48, second opposing wall 49, and a front surface 50. The actuating assembly 44 has an arm 52 thereon. The arm 52 extends downward from and is integrally coupled to the bottom surface 47 of the base portion 45. The arm 52 forms a pawl for selectively engaging the teeth 34 on the gear 32. The arm 52 is located generally adjacent to a corner formed by the first opposing wall 48, the front surface 50 and the bottom surface 47 of the base portion 45. An extension wall 54 extends from the front surface 50 for selective contact with a portion of the pins 11 extending into the annular slot 36. The extension wall 54 is located generally on an edge of the base portion 45 formed by the front surface 40 and the second opposing wall 49. The extension wall 54 is generally co-planar with the second opposing wall 49. The extension wall 54 extends downwardly beyond the bottom wall 47. A button member 56 is fixedly coupled to the top surface 46 of the base portion 45. A distance between the first 48 and second opposing walls 49 is generally equal to a distance between the annular slot 36 and the gear 32.

A bore 58 receives the button member 56. The bore 58 is in the top wall 13 of the housing 12. The bore 56 is generally located between the first 22 and second 26 openings. A portion 60 of the bore 58 located generally adjacent to the second opening 26 extends into the cavity 20 such that the arm 52 and the extension wall 54 may be in selective communication with the wheel 28. The button member 56 extends upwardly through the bore 58.

A spring 60 urges the actuating assembly 44 toward the top wall 13 of the housing 12. The spring 60 is in the bore 58. The spring 60 is coupled to the bottom surface 47 of the base portion 45 of the actuating assembly 44.

Ideally, a strap 62 is fastened to the first wall 15. The strap has loop 64 coupled thereto for placement about a cord which can be worn by the user. Also, a hook and loop fastening means 66 may be attached to the bottom wall 14 of the housing. The housing 12 may then be placed removably coupled to a wrist band, not shown, having a hook and loop fastening means thereon. The housing 12 can then be worn on the wrist of the user.

In use, the pins 11 are placed in the first opening 22 and they accumulate in the pin bin 24. The button 56 is pressed, causing the wheel 28 to turn. As the wheel 28 moves along the pin bin 24, the linear slots 40 pick up pins 11 that are now held between the wheel 28 and the wall of the cavity 20. The pin 11 is rotated up towards the second opening 26. When the actuating means 44 is pressed, the extension wall 54 enters the annular slot 36 and presses the tip of the pin 11 downward. The head of the pin 11 then goes upward for easy grasping by the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A sewing pin dispensing device, said device comprising:

a housing, said housing having a top wall, a bottom wall, a first side wall, a second side wall, a third side wall and a fourth side wall, wherein said first and third side walls are opposite walls and said second and fourth side wall are opposite walls, each of said walls having a generally rectangular shape;

a cavity in said housing, said cavity being located generally adjacent to said third wall and said bottom wall, said cavity having a generally cylindrical cross-section taken along a plane parallel to said second and fourth walls;

a first opening in said housing for entry of pins to be dispensed into said housing, said first opening being in said top wall of said housing, said first opening being located generally adjacent to said first wall, a pin bin formed in said housing and in communication with said first opening and said cavity;

a second opening in said housing for dispensing of said pins, said second opening extending downwardly into said cavity, said second opening being in said top wall of said housing, said second opening being located generally adjacent to said third wall;

a wheel for moving the pins from said pin bin to said second opening, said wheel being rotatably mounted in said cavity, said wheel having a first end, a second end and an exterior surface, said wheel having a width approximately equal to a width of said cavity, said wheel having a length generally equal to a length of said cavity, said length being longer than the length of a stick pin,;

a gear being fixed to said wheel, said gear being fixedly coupled to said first end of said wheel for turning said wheel, said gear being positioned generally coaxial with said wheel, said gear having an edge with teeth formed thereon;

an annular slot in said wheel, said annular slot said being in said exterior surface of said wheel and extending around said wheel, said annular slot being generally adjacent to said second end of said wheel, said annular slot having a first wall and a second wall, said first wall of said annular slot being generally adjacent to said second end of said wheel, said first wall being generally parallel with said second wall of said housing, said second wall of said annular slot being angled toward said first end of said wheel to form an acute angle with exterior surface of said wheel;

a plurality of linear slots in said wheel for each receiving one of said pins, each of said linear slots being in said exterior surface of said wheel, each of said linear slots extending from said annular slot toward said first end of said wheel, each of said linear slots having an end portion, each of said end portions being generally located adjacent to said first end of said wheel, each of said end portions being adapted to receive a head of a pin, wherein each of said end portions of said linear slots have a width greater than a remainder portion of each of said linear slots, each of said linear slots being generally hemi-cylindrical;

an actuating assembly for actuating said wheel, said actuating assembly having a base portion, said base portion having a top surface, a bottom surface, a first opposing wall and second opposing wall, and a front surface, said actuating assembly having an arm thereon, said arm extending downward from and integrally coupled to said bottom surface of said base portion, said arm forming a pawl for selectively engaging said teeth on said gear, said arm being located generally adjacent to a corner formed from said first opposing wall, said front surface and said bottom surface of said base portion, an extension wall extending from said front surface for selective contact with a portion of the pins extending into said annular slot, said extension wall being located generally on an edge of said base portion formed by said front surface and said second opposing wall, said extension wall being generally co-planar with said second opposing wall, said extension wall extending downwardly beyond said bottom surface, a button member being fixedly coupled to said top surface of said base portion, a distance between said first and second opposing walls being generally equal to a distance between said annular slot and said gear;

a bore for receiving said button member, said bore being in said top wall of said housing, said bore being generally located between said first and second openings, a portion of said bore located generally adjacent to said second opening extending into said cavity such that said arm and said extension wall may by in selective communication with said wheel, said button member extending upwardly through said bore; and a spring for urging said actuating assembly toward said top wall of said housing, said spring being in said bore, said spring being coupled to said bottom surface of said base portion of said actuating assembly.

2. A sewing pin dispensing device, said device comprising:

a housing having a top wall, a bottom wall, a first side wall, a second side wall, a third side wall and a fourth side wall, wherein said first and third side walls are opposite walls and said second and fourth side wall are opposite walls, each of said walls having a generally rectangular shape;

a cavity being located in said housing;

a first opening in said housing for entry of pins to be dispensed into said housing, a pin bin formed in said housing and in communication with said first opening and said cavity;

a second opening in said housing for dispensing of said pins, said second opening extending downwardly into said cavity;

a wheel for moving the pins from said pin bin to said second opening, said wheel being rotatably mounted in said cavity, said wheel having an exterior surface, said wheel having a first end a second end, said wheel having a width approximately equal to a width of said cavity, said wheel having a length generally equal to a length of said cavity;

a gear fixed to said wheel, said gear being fixedly coupled to said an end of said wheel for turning said wheel, said gear being fixedly coupled to said first end of said wheel for turning said wheel, said gear being positioned generally coaxial with said wheel, said gear having an edge with teeth formed thereon;

an annular slot in said wheel, said annular slot said being in said exterior surface of said wheel and extending around said wheel, said annular slot being generally adjacent to said second end of said wheel, said annular slot having a first wall and a second wall, said first wall of said annular slot being generally adjacent to said second end of said wheel, said first wall being generally parallel with said second wall of said housing, said second wall of said annular slot being angled toward said first end of said wheel to form an acute angle with exterior surface of said wheel;

a plurality of linear slots in said wheel for each receiving one of said pins, each of said linear slots being in said exterior surface of said wheel, each of said linear slots extending from said annular slot toward said first end of said wheel, each of said linear slots having an end portion, each of said end portions being generally located adjacent to said first end of said wheel, each of said end portions being adapted to receive a head of a pin, wherein each of said end portions of said linear slots have a width greater than a remainder portion of each of said linear slots, each of said linear slots being generally hemi-cylindrical; and an actuating assembly for actuating said wheel.

3. The sewing pin dispensing device as in claim 2, wherein said cavity is located generally adjacent to said third wall and said bottom wall, said cavity having a generally cylindrical cross-section taken along a plane parallel to said second and fourth walls.

4. The sewing pin dispensing device as in claim 3, wherein said first opening is in said top wall of said housing, said first opening being located generally adjacent to said first wall.

5. The sewing pin dispensing device as in claim 2, wherein said second opening is in said top wall of said housing, said second opening being located generally adjacent to said third wall.

6. The sewing pin dispensing device as in claim 1, wherein said actuating assembly has a base portion, said base portion having a top surface, a bottom surface, a first opposing wall and second opposing wall, and a front surface, said actuating assembly having an arm thereon, said arm extending downward from and integrally coupled to said bottom surface of said base portion, said arm forming a pawl for selectively engaging said teeth on said gear, said arm being located generally adjacent to a corner formed from said first opposing wall, said front surface and said bottom surface of said base.

7. The sewing pin dispensing device as in claim 6, wherein said actuating device further comprises:

an extension wall extending from said front surface for selective contact with a portion of the pins extending into said annular slot, said extension wall being located generally on an edge of said base portion formed by said front surface and said second opposing wall, said extension wall being generally co-planar with said second opposing wall, said extension wall extending downwardly beyond said bottom surface of said base portion.

8. The sewing pin dispensing device as in claim 7, wherein said actuating device further comprises:

a button member being fixedly coupled to said top surface of said base portion, a distance between said first and second opposing walls being generally equal to a distance between said annular slot and said gear.

9. The sewing pin dispensing device as in claim 8, further comprising:

a bore for receiving said button member, said bore being in said top wall of said housing, said bore being generally located between said first and second openings, a portion of said bore located generally adjacent to said second opening extending into said cavity such that said arm and said extension wall may by in selective communication with said wheel, said button member extending upwardly through said bore.

10. The sewing pin dispensing device as in claim 9, further comprising:

a spring for urging said actuating assembly toward said top wall of said housing, said spring being in said bore, said spring being coupled to said bottom surface of said base portion of said actuating assembly.

* * * * *